US007168653B2

(12) United States Patent
Omdoll et al.

(10) Patent No.: US 7,168,653 B2
(45) Date of Patent: Jan. 30, 2007

(54) LOW COST ROLL DISPENSER

(75) Inventors: Paul Omdoll, Waukesha, WI (US); Scott Collins, Milwaukee, WI (US)

(73) Assignee: The Colman Group, Inc., Elkhorn, WI (US)

( * ) Notice: Subject to any disclaimer, the term of this patent is extended or adjusted under 35 U.S.C. 154(b) by 0 days.

(21) Appl. No.: 10/339,194

(22) Filed: Jan. 9, 2003

(65) Prior Publication Data

US 2004/0135028 A1 Jul. 15, 2004

(51) Int. Cl.
*B65H 16/10* (2006.01)

(52) U.S. Cl. ..... 242/564.2; 242/565; 242/595

(58) Field of Classification Search ..... 242/564, 242/564.1, 564.2, 564.4, 564.5, 565, 579, 242/580, 595; 312/34.22
See application file for complete search history.

(56) References Cited

U.S. PATENT DOCUMENTS

| | | | | |
|---|---|---|---|---|
| 2,334,689 | A | 11/1943 | Wooster | |
| 2,957,738 | A | 10/1960 | Marcuse | |
| 3,294,460 | A | 12/1966 | Wooster et al. | |
| 3,489,361 | A | 1/1970 | Marion et al. | |
| 3,672,552 | A * | 6/1972 | Krueger et al. | 242/564.2 |
| 4,236,679 | A | 12/1980 | Jespersen | |
| 4,552,315 | A * | 11/1985 | Granger | 312/34.22 |
| 4,563,077 | A * | 1/1986 | Komada | |
| 5,400,982 | A | 3/1995 | Collins | |
| 5,645,244 | A | 7/1997 | Moody | |
| 6,102,269 | A * | 8/2000 | Elliott et al. | 242/564.2 |
| 6,112,631 | A * | 9/2000 | VanAlstine | 242/564.1 |
| 6,206,322 | B1 * | 3/2001 | Elliott et al. | 242/564.2 |
| 6,302,351 | B1 | 10/2001 | Omdoll et al. | |
| 6,363,824 | B1 * | 4/2002 | Granger | 242/564.4 |
| 6,412,655 | B1 | 7/2002 | Stuetzel et al. | |
| 6,412,679 | B2 | 7/2002 | Formon et al. | |
| 6,419,113 | B1 | 7/2002 | Tramontina | |
| 6,446,901 | B1 * | 9/2002 | Haen et al. | 242/564.1 |
| 6,607,160 | B2 * | 8/2003 | Lewis et al. | 242/564.4 |

* cited by examiner

*Primary Examiner*—William A. Rivera
(74) *Attorney, Agent, or Firm*—Boyle Fredrickson Newholm Stein & Gratz S.C.

(57) ABSTRACT

A low cost roll dispenser includes a housing with an interior and a feeding mechanism. The housing has an interior with a shape, which may be a ramp or series of ramps, that biases a roll of sheet material forward so that it is in constant contact with the shape and the feeding mechanism while the roll is stationary and while the roll is being unwound. The low cost roll dispenser may have a cover and an integrated handle that drives the feeding mechanism that attach to the housing without the use of any tools.

20 Claims, 6 Drawing Sheets

LOW COST ROLL DISPENSER

BACKGROUND OF THE INVENTION

This invention relates generally to dispensers for dispensing sheet material. More particularly, this invention relates to a low cost roll dispenser for dispensing paper towels.

Dispensers for rolls of flexible sheet material, such as paper toweling, have been employed for a great many years. Dispensers are widely used in public lavatories to dispense paper toweling for users to dry their hands. Typically, a roll of sheet material is rotatably supported inside the dispenser cabinet. A user actuates a crank or lever that drives a feed mechanism for dispensing the sheet material. The feed mechanism typically includes a drive roller and an idle roller. The crank or lever interacts with the drive roller so that actuation of the crank or lever rotates the drive roller. Rotation of the drive roller acts to unwind the sheet material roll. The crank or lever is usually a separate mechanism from the housing of the roll dispenser.

Rolls have generally been supported inside the dispenser by a series of parts. Such parts include rollers, pulleys, hangars and the like. In addition to supporting and positioning the roll inside the dispenser, these parts were necessary to control the speed at which the roll unwound. These additional parts lead to increased expense in the manufacture and service of the dispenser.

Recently, the present inventors developed a concept for a roll supported by a ramp positioned inside the dispenser as shown in U.S. Pat. No. 6,302,351. The '351 Patent teaches a dispenser for a plurality of rolls as shown in FIG. 2. During operation, the primary roll moves down the ramp and eventually falls into a trough when its diameter reaches a set size. The '351 Patent shows a dispenser with a trough a bottom wall, an opening between the bottom wall and a lower part, a slot that allows an empty roll to fall from the trough, and a catch mechanism to catch the empty roll. As such, the '351 Patent requires a relatively complicated structure to achieve its purpose.

In addition, the structure of the '351 Patent permits the roll to move inside the dispenser without a contact point with either the ramp or the drive roller. This occurs when the roll reaches a small diameter and falls into the trough. In that position, the roll is able to move uncontrollably Such unfettered movement can lead to the roll bouncing around the inside of the dispenser. Bouncing of the roll can bunch the sheet material thereby jamming the feed mechanism. Such bouncing can also produce undesirable noise.

Accordingly, a need exists for a low cost roll dispenser that contains a minimal number of parts, thereby reducing costs associated with manufacturing and servicing of the dispenser. It would be desirable to have a roll dispenser that positions the roll so that the movement of the roll is constantly controlled without using a large number of parts.

SUMMARY OF THE INVENTION

The present invention provides for a roll dispenser that is cost-effective, positions the roll so that the movement of the roll is constantly controlled, is aesthetically pleasing, and which solves some of the problems of existing designs.

The invention generally comprises a roll dispenser that can accommodate both core and core-less rolls. The roll dispenser provides for a shaped biasing ramp inside the dispenser that acts to bias the roll forward so that it is in constant contact with both the ramp and the feeding mechanism. By biasing the roll forward, the roll maintains a degree of pressure on the feeding mechanism that is a function of the size of the roll.

In one embodiment, the invention also provides for a handle that is integrated into the cover of the dispenser.

In another embodiment, this invention provides for a dispenser that is easily assembled without using any tools.

In yet another embodiment, the feed mechanism is configured as a removable cassette that can be assembled without using any tools. Preferably, once assembled, the cassette can be fit into the housing of the dispenser without using any tools.

DETAILED DESCRIPTION OF THE PREFERRED EMBODIMENTS

Figure 1:
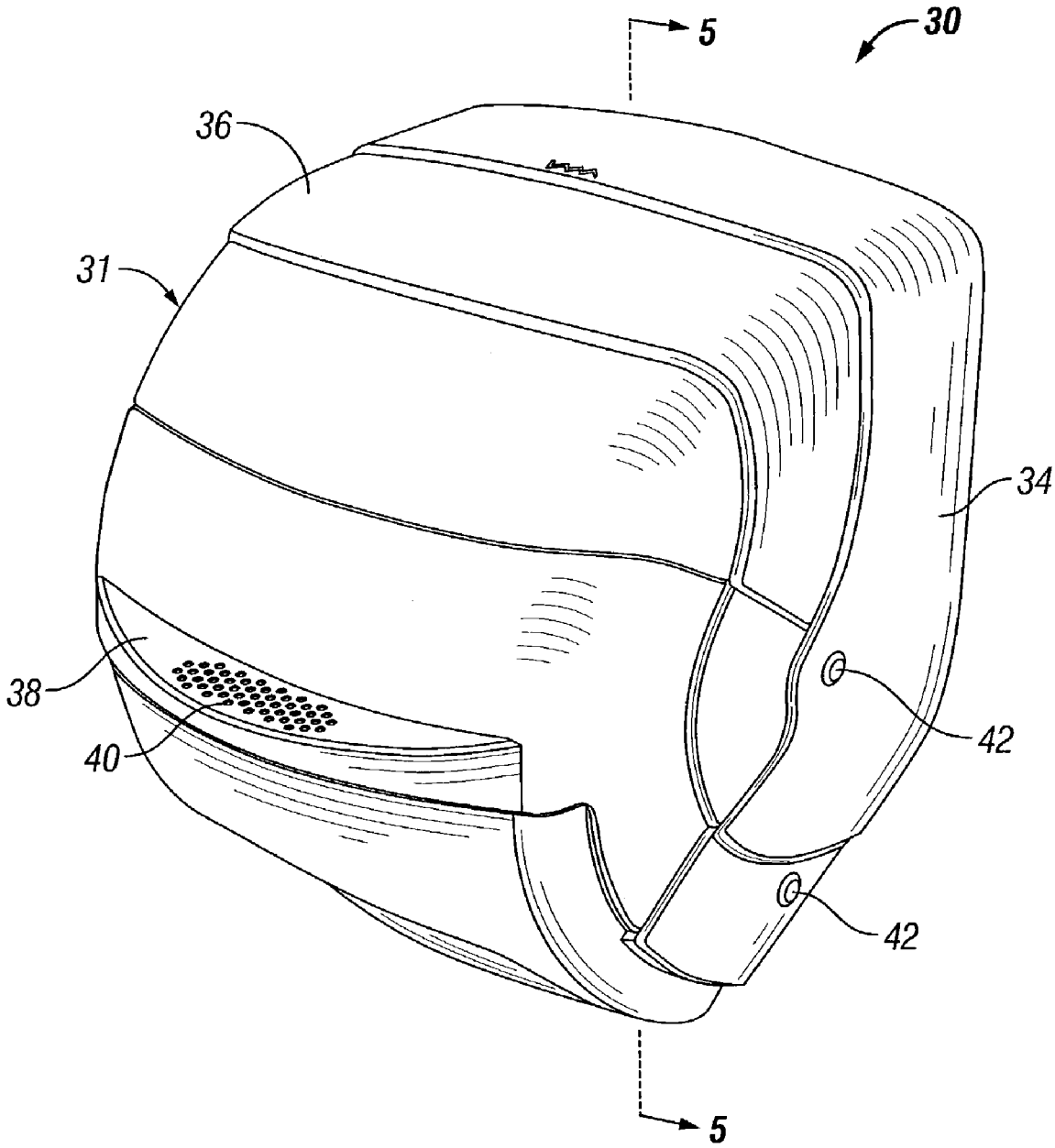
FIG. 1 is a perspective view of a low cost roll dispenser in accordance with one embodiment of the present invention.

Illustrative embodiments of a low cost roll dispenser (identified generally as 30) in accordance with the present invention are shown in FIGS. 1 through 7. While the invention may be susceptible to embodiment in different forms, there is shown in the drawings, and herein are described in detail, certain illustrative embodiments with the understanding that the present disclosure is to be considered an exemplification of the principles of the invention, and is not intended to limit the invention to those as illustrated and described herein. Additionally, features illustrated and described with respect to one embodiment could be used in connection with other embodiments.

Figure 4:
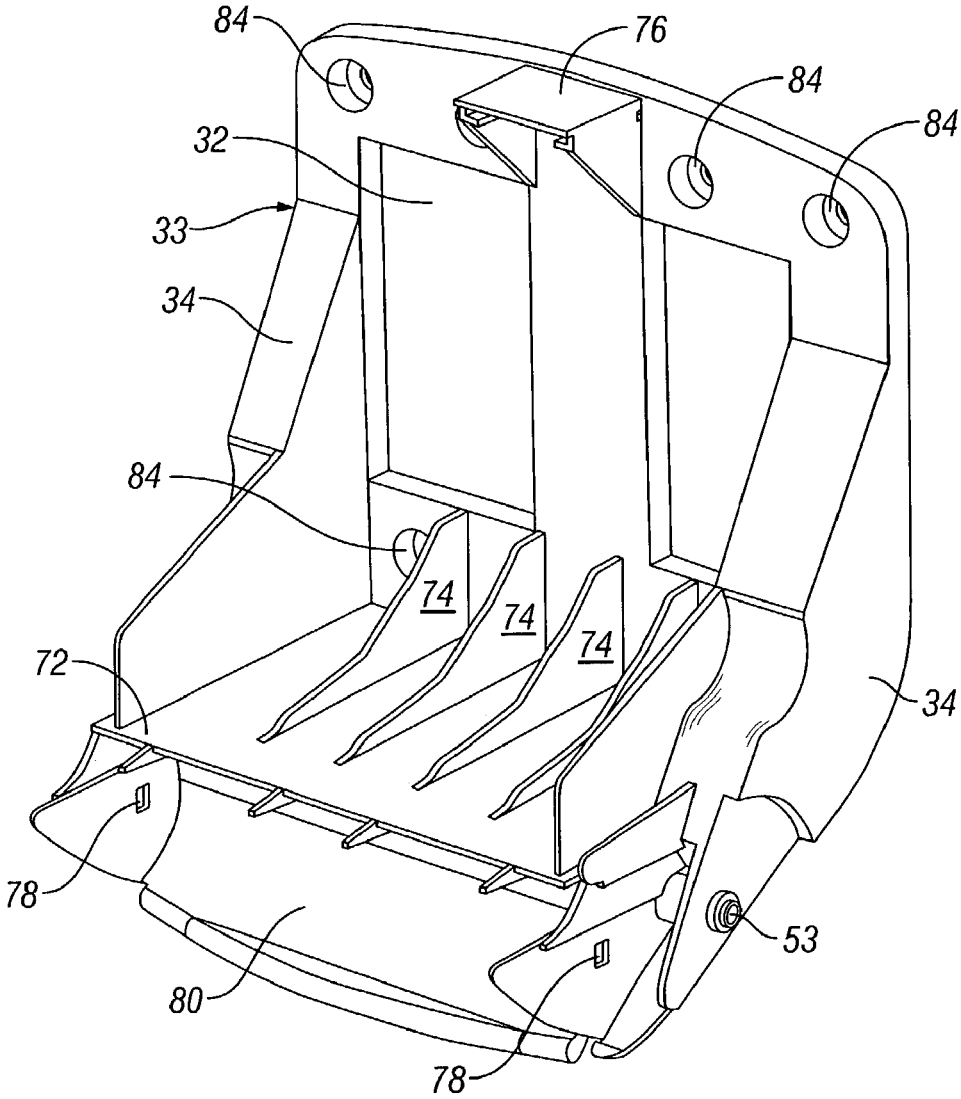
FIG. 4 is a perspective view of the rear cover of the housing of a low cost roll dispenser in accordance with one embodiment of the present invention.
Figure 7:
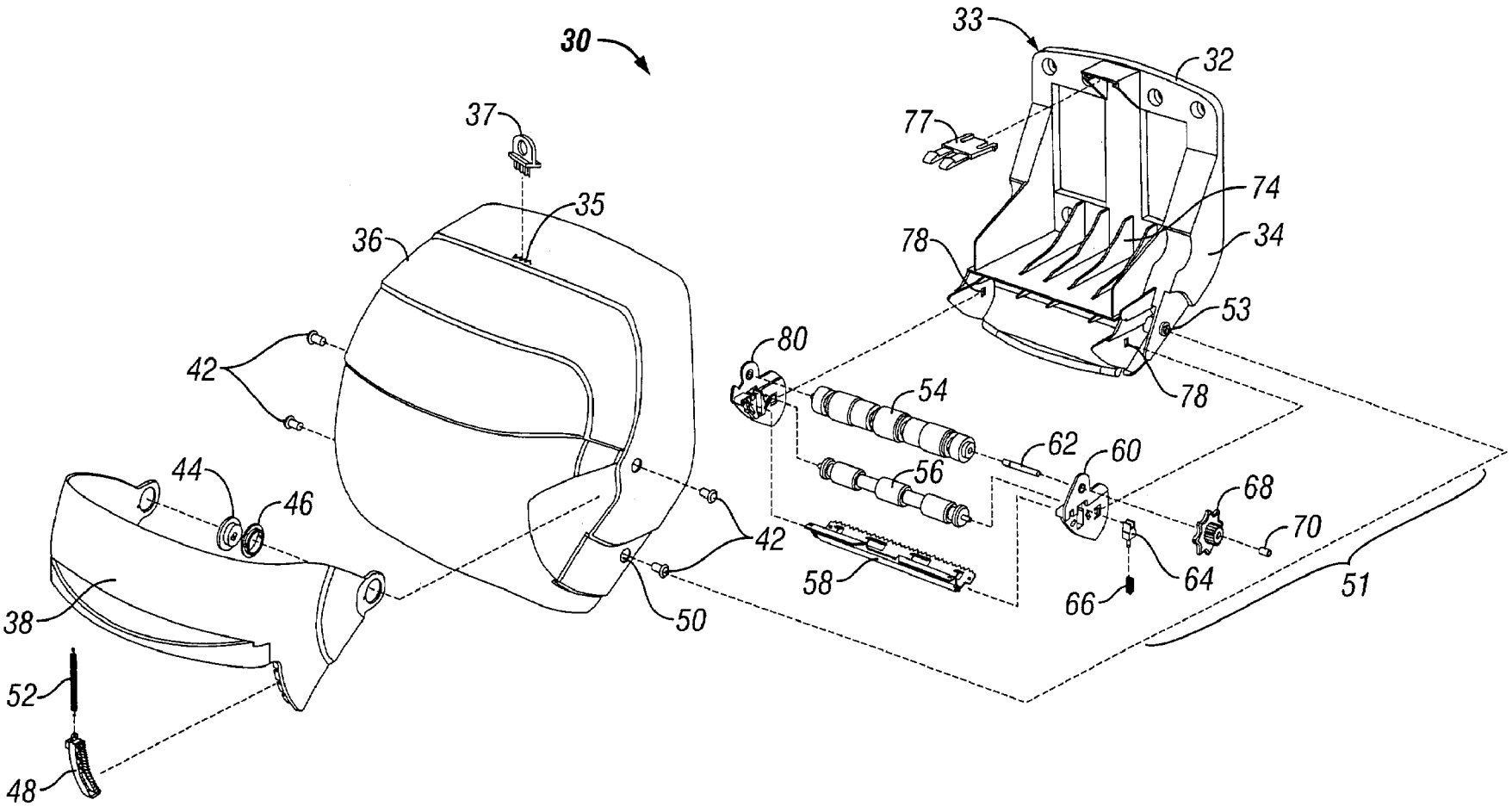

The low cost roll dispenser 30 of the present invention holds a roll of dispensable material 82 inside a housing 31. As shown in FIGS. 1 and 7, the housing 31 comprises a back wall 32, sidewalls 34, a floor 72 and a cover 36. The housing 31 may be formed of plastic or other suitable material. The back wall 32, sidewalls 34, and floor 72 form the rear cover of the housing 31 as shown in FIG. 4. The rear cover 33 may be a single piece formed by injection, blow, or roto molding. Alternatively, they may be separately manufactured parts that are connected by welds, moldings, fasteners, solder, or the like. The back wall 32, sidewalls 34, floor 72 and front cover 36 together form a space into which a roll 82 may be placed.

In one embodiment, shown in FIGS. 1 and 7, the dispenser 30 of the present invention provides for a handle 38 that attaches to the housing 31 and engages a feeding mechanism 51. Actuation of the handle 38 rotates the drive roller 54 thereby unwinding the roll 82. Unwinding the roll 82 produces a predetermined amount of sheet material from the dispenser 30.

Figure 3:
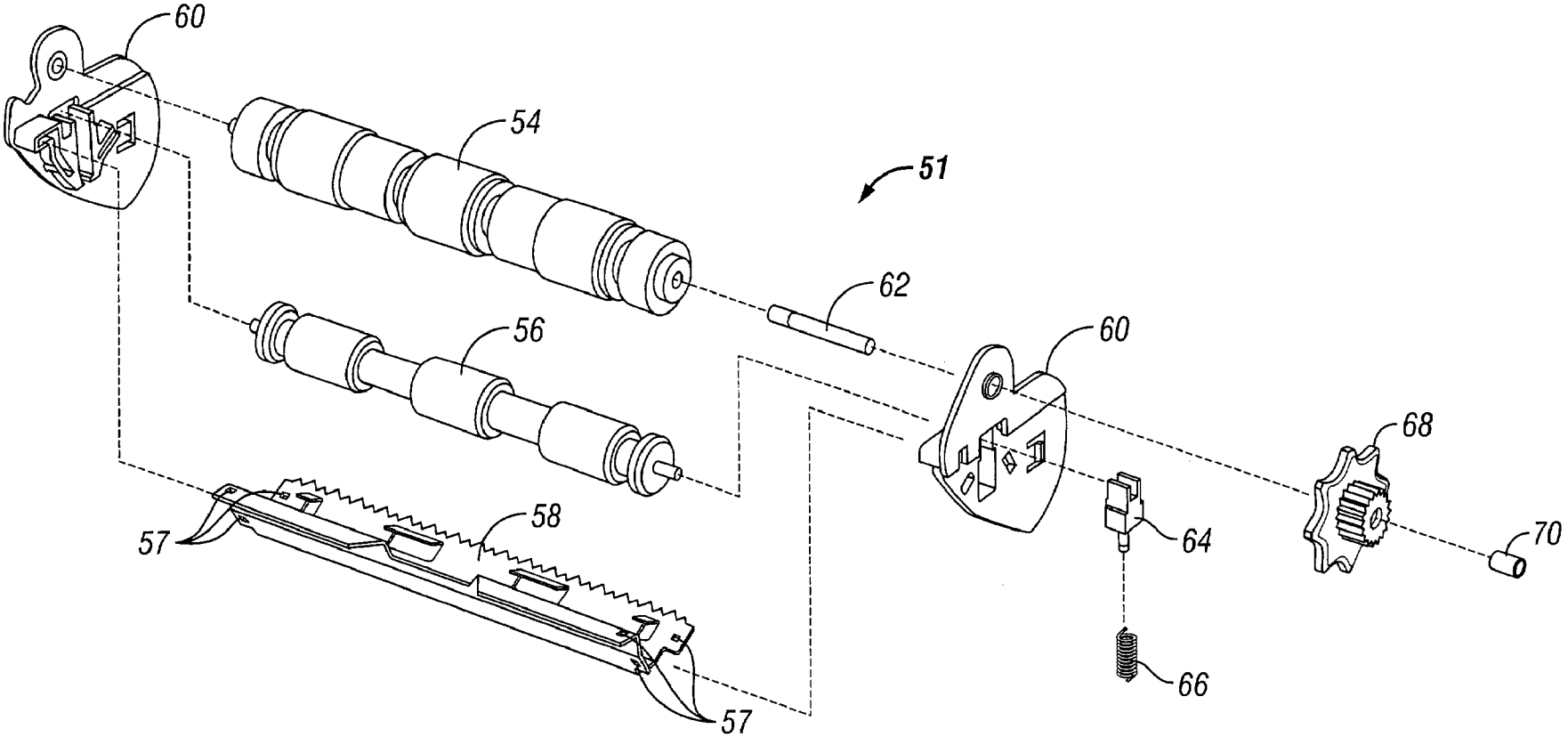
FIG. 3 is an exploded view of the cassette of a low cost roll dispenser in accordance with one embodiment of the present invention.
Figure 5:
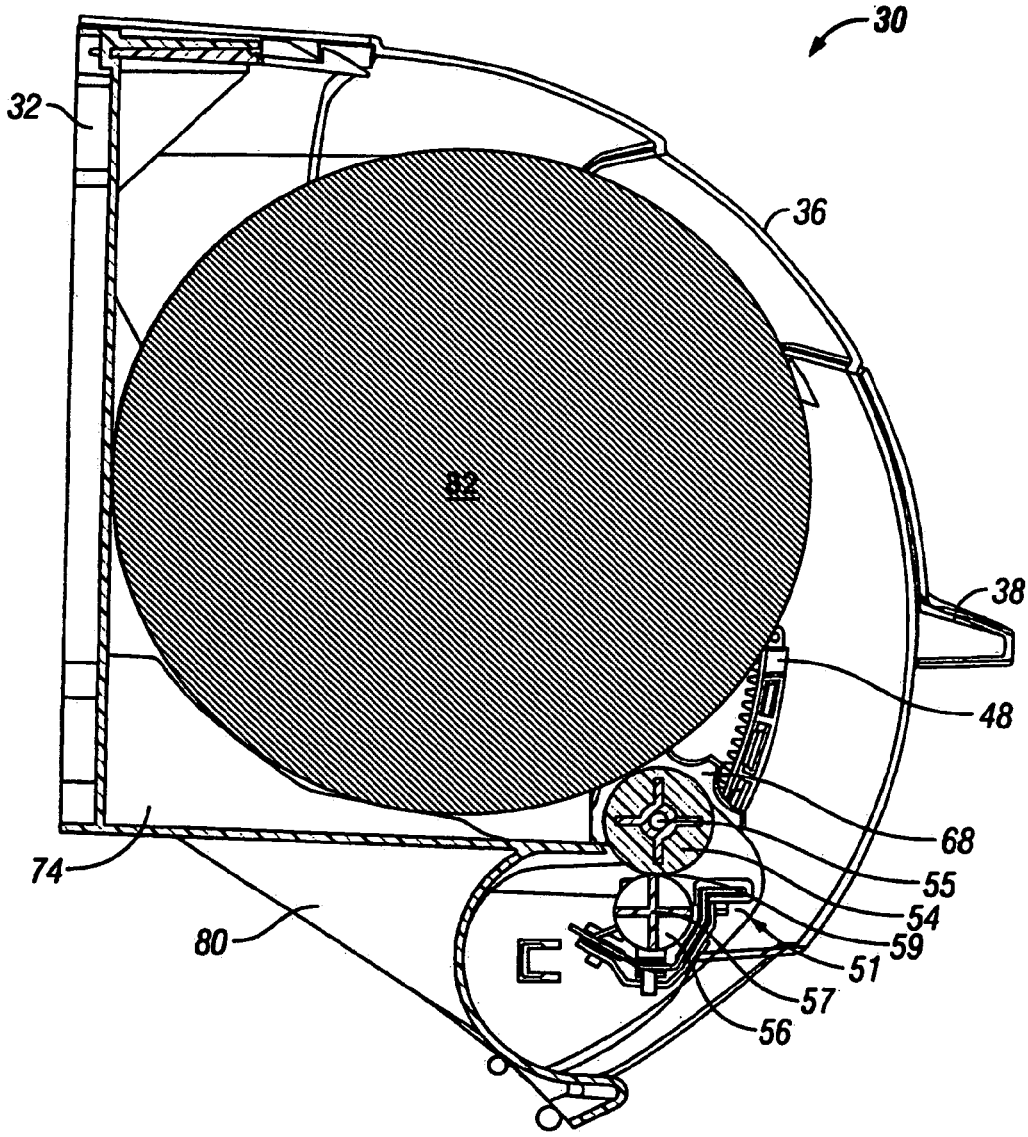
FIG. 5 is a cross-sectional view of the low cost roll dispenser shown in FIG. 1, taken generally along line 5—5 of FIG. 1.

The driver roller 54 and idle roller 56 form a portion of the feeding mechanism. In one embodiment shown in FIG. 3, the feeding mechanism is assembled in the form of a cassette 51. As shown in FIG. 5, the drive roller 54 and idle roller 56 cooperate to form a pressure nip 59 through which the sheet material is drawn before being dispensed. As shown in FIG. 3, the drive roller 54 and idle roller 56 extend transversely with respect to and are supported from the sidewalls 34 for rotation about respective axes 55 and 57. Axes 55 and 57 are parallel to each other and are generally parallel to the rotational axis of the roll 82.

In one embodiment, the opposite ends of the drive roller 54 are journalled in a suitable manner so that the axis 55 is fixed. As shown in FIG. 3, such journalling can be accomplished by a drive pin 62 and bearing blocks 60.

The opposite ends of the idler roller 56 are mounted so that the axis 57 is able to be moved towards and away from the axis 55 of the drive roller 54. The ends of the idler roller 56 are preferably spring biased to urge the idler roller 56 into engagement with the drive roller 54. As shown in FIG. 3, this may include a push-block or spring holder 64 and a spring-bearing block 66 that can be inserted into each of the bearing blocks 60. Alternatively, the idler roller 56 may be fixed and the drive roller 54 may be mounted so that the axis 55 of the drive roller 54 is biased towards the axis 57 of the idle roller 56. Regardless of which roller is moveable, the drive roller 54 may be positioned either above or below the idler roller 56.

The ability of one of the rollers to move allows the pressure nip 59 to accommodate a variety of thicknesses of sheet material. Such ability allows the dispenser 30 to be easily used with core-less rolls. Core-less rolls have a center formed of tightly wound material. The center is commonly referred to as a "cigarette." The cigarette will not unroll as does the outer portions of the roll. A section of sheet material may be visible when the core-less roll is almost completely dispensed from the low cost roll dispenser 30. A user may see this section and tug on it hoping to pull sheet material from a dispenser. Doing so causes the cigarette to contact the drive roller and the idle roller. The rollers of traditional dispensers do not have the available travel to accommodate passage of the cigarette. As such, the cigarette can become jammed in the rollers. The present invention provides for sufficient travel between the drive roller 54 and idler roller 56 so that the cigarette can be easily passed through the pressure nip 59 by actuation of the handle 38.

The present invention also provides for the use of a feed mechanism in the form of a cassette 51 that can be assembled without the use of any tools. In one embodiment, as shown in FIG. 3, one end of the drive roller 54 and idle roller 56 is fit into a bearing block 60. The other end of each roller is fit into another bearing block 60. As described above, a drive pin 62 is used to secure the drive roller 54 into one of the bearing blocks 60. Spring holders 64 and spring bearing blocks 66 are used to secure the idle roller 56 into the bearing blocks 60. The drive pin 62 engages the drive roller 54 and the bearing block 60. The drive pin 62 extends out from the bearing block 60 and engages a thumbwheel gear 68. The drive pin 62 also extends out from the thumbwheel gear 68. A one-way clutch 70 is positioned onto the drive pin 62 thereby securing the thumbwheel gear 68 to the drive pin 62 and bearing block 60. These parts may be formed of plastic or other suitable material. As shown in FIG. 3, a blade 58 is also preferably fit into the bearing blocks 60. Hooks on the blade 58 are used to hold the entire cassette together.

Once assembled, the cassette 51 may be fit into the housing 31 without the use of any tools. Traditional dispensers require inserting the parts that comprise the feed mechanism into a chassis, which is then inserted into the housing. In one embodiment as shown in FIG. 7, the cassette 51 may be snap fit into the housing where each of the bearing blocks 60 matingly engages an insert 78 located in the housing. This direct mounting eliminates the need for any chassis. Eliminating the chassis reduces the number of pieces and amount of material required to construct the dispenser 30. Such reduction streamlines the manufacturing process thereby lowering costs.

The cassette 51 may also be easily removed from the housing with a screwdriver or other small hand tool. This makes it simple and inexpensive to replace the entire feed mechanism in the field, with little effort. Furthermore, this construction minimizes the parts and the overall portion of the dispenser 30 that would need to be replaced in the field. As such, maintenance and service costs are also reduced.

Figure 2:
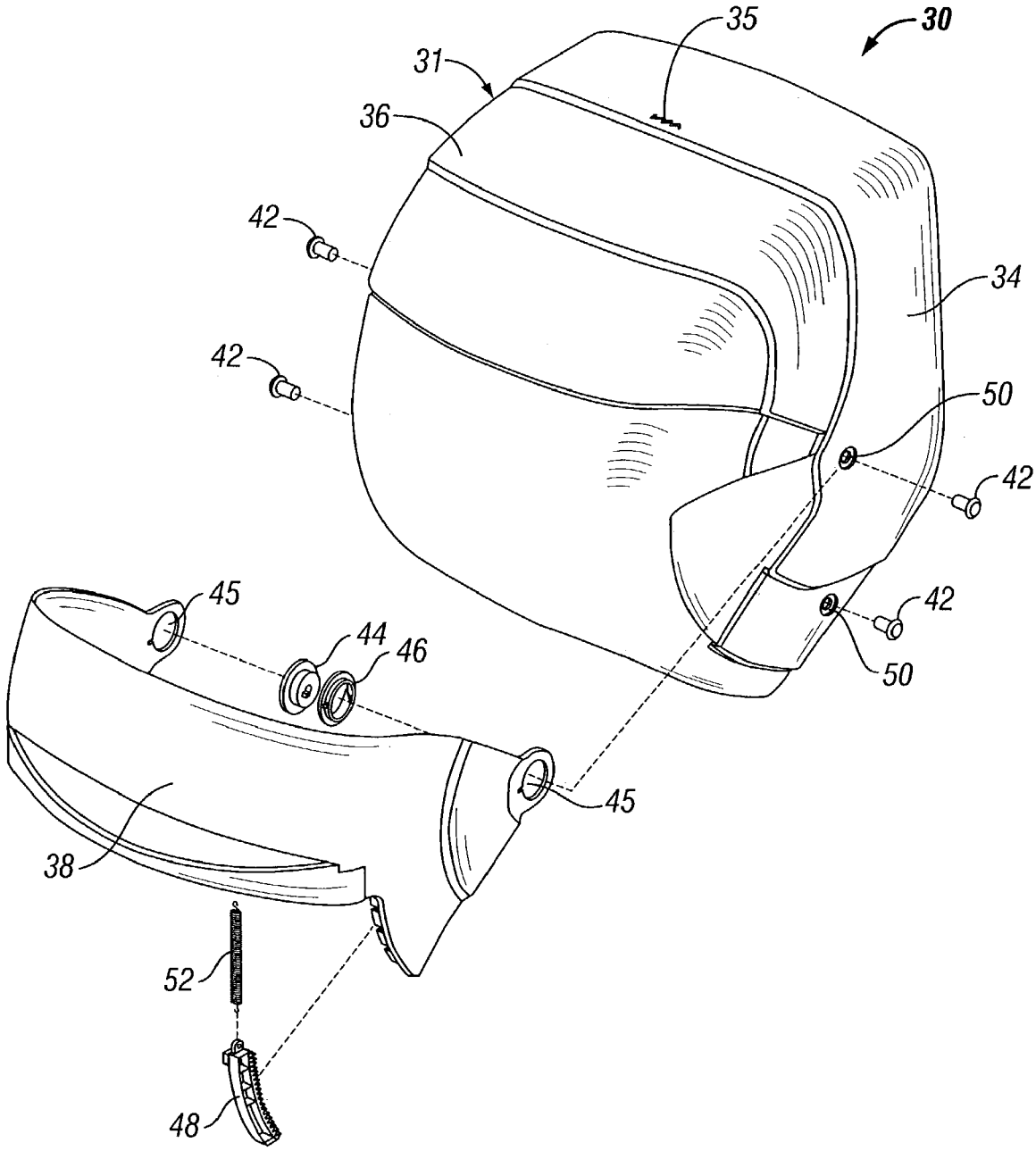
FIG. 2 is an exploded view of the cover and handle of the low cost roll dispenser shown in FIG. 1.

In one embodiment of the present invention, as shown in FIGS. 1, 2 and 7, a handle 38 is an integrated part of the dispenser 30. Specifically, the handle 38, along with the cover 36, form the front of the dispenser 30. Both the handle 38 and the cover 36 fit onto the rear cover 33 of the housing 31. In one embodiment, the handle 38 and front cover 36 snap fit onto the rear cover 33. The cover 36 is rotatably fit onto the sidewalls 34, of the rear cover 33 by use of two pivot posts 42. Each pivot post 42 passes through a pivot post opening 50 in the front cover 36 and into corresponding openings 53 in the sidewalls 34. The pivot posts 42 securely engage the sidewalls 34 and the front cover 36. The pivot posts 42 allow the front cover 36 to open downwardly so that a roll 82 may be easily positioned inside the housing 31. The back wall 32 preferably has an attachment member 76 cooperating with a finger placard 77 to secure the front cover 36 to the back cover and thereby form the entire housing 31. Further, a lock 35 and key 37 mechanism may be employed to prevent unauthorized personnel from gaining access to the interior of the housing 31.

In one embodiment, as shown in FIG. 2, the handle 38 is attached to the front cover 36 after the front cover 36 is mated with the rear cover 33. Specifically, a bearing cap 44 mates with a bearing 46. Together, one bearing cap 44 and one bearing 46 are passed through and engage each orifice 45 located on the handle 38. The handle 38, with accompanying bearing caps 44 and bearings 46, is fit onto the front cover 36. A pivot post 42 is inserted into an opening 50 in the front cover 36. The pivot posts 42 engage the bearing caps 44. Such engagement allows the handle 38 to be actuated with respect to the housing.

A pair of spring cover returns 52 are preferably attached to a rack gear 48 which is interlocked with the handle 38. Actuation of the handle 38 by the user forces the rack gear 48 downward. As shown in FIG. 5, the rack gear 48 is in contact with the thumbwheel gear 68 thereby rotating the thumbwheel gear 68, which in turn rotates the drive roller 54. Since sheet material from the roll 82 is threaded into the pressure nip 59 between the drive roller 54 and the idler roller 56, rotation of the drive roller 54 pulls on the sheet material, which unwinds the roll 82. Thus, actuation of the handle 38 causes the drive roller 54 to rotate thereby feeding a predetermined amount of sheet material through the roller assembly 51. Thus, after actuation, the spring-cover return 52 returns the handle 38 to its resting position. The one-way clutch 70 prevents the handle 38, while returning to its resting position, from further rotating the drive roller 54.

As shown in FIG. 1, the handle 38 is designed so as to improve the overall appearance and functionality of the dispenser 30. Integrating the handle 38 into the cover 36 provides for a sleek, aerodynamic look. Integrating the handle 38 into the cover 36 also allows for the dispenser 30 of the present invention to have a decreased width compared to that of traditional dispensers. In addition, by virtue of this design the handle 38 is larger than that of traditional dispensers with a broad frontal area making it far easier for physically challenged individuals to actuate. Still further, the handle's location is such that it is unobstructed by the sheet material being dispensed. Perhaps even more important, the handle 38 is positioned and shaped so that it may be actuated by a user's elbow or forearm, a practice common among those not wishing to touch things in a public restroom. As shown in FIG. 1, the handle may be textured or ribbed 40 so that water runs off the handle 38 and so that the handle 38 is easier to actuate.

The dispenser 30 of the present invention does not include a hanger, roller, or pulley for supporting the roll 82 above the drive roller 54. Instead, the dispenser 30 supports the roll 82 so that the roll 82 is, at least in part, resting on the driver roller 54. The housing 31 has an interior ramp 74 with a shape that biases the roll forward onto the feeding mechanism so that the roll is in constant contact with both the rear housing 33 and the feed mechanism. The roll substantially maintains these contacts while the roll is stationary and while the roll is being unwound.

Once the roll 82 is placed inside the dispenser 30 of the present invention, the outer surface of the roll 82 is biased by gravity against the ramp and the outer surface of the drive roller 54. The result is that the roll 82 exerts a pressure on the drive roller 54 that varies in relation to the mass of the roll 82. By virtue of the shape of the ramp 74, the roll 82 is indexed or biased forward so that it applies a substantially constant pressure to the drive roller 54 yet minimizes the drag and force required to rotate the roll 82. Preferably, the applied pressure is not great enough to create excessive drag between the roll 82 and the driver roller 54 and to allow a low actuation force to dispense sheet material even when the roll 82 is large. Specifically, in one embodiment for use with 800 foot paper towel rolls as shown in FIG. 5, less than 5 pounds of pressure is required to actuate the handle 38 and dispense sheet material.

The shape of the ramp 74 also is configured to provide sufficient pressure to prevent the roll 82 from bouncing uncontrollably around the inside of the housing when the handle 38 is actuated. More particularly, the gravity-biased engagement of the roll 82 with the drive roller 54 and the shape prevents the roll 82 from freewheeling when the handle 38 is actuated. Preferably, as shown in FIG. 5, the sheet material is unwound from the bottom of the roll 82. In addition, the roll 82 is in rolling engagement with the drive roller 54. This combination allows the rotation of the drive roller 54 to rotate and thereby unwind the roll 82. The result is that it is possible to pull the sheet material and unwound the roll without the need for the use of appreciable force.

This design eliminates the need for the many parts normally required to support the roll in traditional roll dispensers. As a result, the costs of manufacturing, maintaining, and repairing the dispenser 30 of the present invention are reduced. In addition, this design allows for ease in refilling the dispenser 30 with rolls 82. There is no need to attach any parts to the roll 82 nor fit the roll 82 onto any supports or guides. Instead, the cover 36 is opened, the core removed, (if there is one) a new roll 82 placed on the ramp 74, the lead of the roll fed through the feeding mechanism 51, and the cover 36 is closed. As a result, the low cost roll dispenser 30 can accommodate and dispense sheet material from both core and core-less rolls without any modification or installation of additional parts.

In a preferred embodiment of the present invention the ramp 74 is formed by a series of support ridges provided inside the housing. In still another embodiment, the ramp is a single, solid support mounted inside the housing.

In a preferred embodiment, as shown in FIGS. 4, 5, 6, and 7, the roll 82 rides in a space defined between the outer surface of the drive roller 54 and a series of laterally spaced support ridges 74. The individual ridges 74 extend inwardly from the back wall 32. The back portion 102 of the ridges intersects the back wall 32 while the bottom portion 104 of the ridges intersects the floor 72. When the housing is molded from a synthetic plastic in accordance with a preferred embodiment, the ramp 74 can be molded as an integral part of either the floor 72, or the back wall 32.

Using a plurality of support ridges as shown in FIG. 4 allows the roll 82 to be biased forward while minimizing the contact area between the ramp 74 and the roll 82. Minimizing this contact area decreases the friction generated as the roll 82 unwinds against the ramp 74. Correspondingly, decreasing this friction decreases the amount of force needed to actuate the handle 38 and dispense sheet material.

In one preferred embodiment, of the present invention, the support ridges have a thickness of between about 1/16 and 1/4 of an inch, most preferably 1/8 of an inch. these dimensions are preferable because such a thickness does not generally cut or otherwise mark the sheet material while the roll 82 is resting on the ramp 74 or is unwound.

Figure 6:
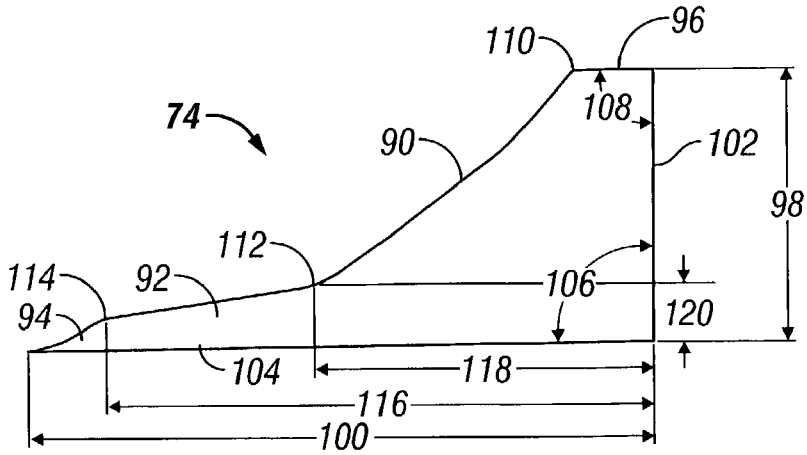
FIG. 6 is a side view of a ramp of the low cost dispenser shown in FIG. 4; and, FIG. 7 is an exploded view of a low cost dispenser in accordance with one embodiment of the present invention.

As shown in FIGS. 4, 5, and 6, in one embodiment of the present invention, the support ridges have three different sections; each section with a somewhat different profile or degree of incline. The upper section 90 is "in play" when the roll 82 is relatively large. At that point the roll 82 has at least two contact points with the upper section 90 (ignoring for the moment each separate point of contact with each support ridge comprising the ramp) and a second with the drive roller 54. As the roll 82 is unwound and decreases in size, it moves down the ramp 74 to the middle section 92. At this point, the roll 82 again has two contact points (still ignoring each separate point of contact with each support ridge), one with the middle section 92 and the second with the drive roller 54. As the roll 82 is further unwound and decreases further in size, it travels down the ramp 74 to the bottom section 94. At this point, the roll 82 again has two contact points (still ignoring the separate point of contact with each support ridge), one with the bottom section and the second with the drive roller 54.

As shown in FIG. 6, in one preferred embodiment of the present invention, the bottom section 94 is the steepest, the middle section 92 has the least degree of incline of any of the sections and the upper section 90 has a degree of incline between that of the bottom section 94 and the middle section 92. In yet another embodiment of the present invention, the ramp 74 may include a fourth section, a top section 96, to facilitate biasing of the roll 82 into the correct position relative to the drive roller 54.

In one preferred embodiment of the present invention, each support ridge of the ramp 74 has the following measurements: a height 98 preferably between 2.46 to 1.64 inches; most preferably 2.05 inches; a length 100 preferably between 5.772 to 3.848 inches, most preferably 4.81 inches; an angle 108 preferably between 71.4° to 105.6°, most preferably 88°; an angle 106 preferably between 110.4° and 73.6°, most preferably 92°; a curved slope 110 with a radius preferably between 0.15 and 0.10 inches, most preferably 0.125 inches; a curved slope 112 with a radius preferably between 0.6 and 0.4 inches, most preferably 0.50 inches; a curved slope 114 with a radius preferably between 0.3 and 0.2 inches, most preferably 0.250 inches; a combined length 116 preferably between 5.04 and 3.36 inches, most preferably 4.20 inches; a combined length 118 preferably between 2.976 and 1.984 inches, most preferably 2.480 inches; and a combined height 120 preferably between 0.4608 and 0.3054 inches, most preferably 0.384 inches.

In one embodiment of the present invention, the dispenser 30 is partially or completely formed of a transparent material. Employing a transparent material allows a service person to see the amount of sheet material remaining in the dispenser 30 without opening the cover 36.

From the foregoing description, it can be seen that the dispenser 30 provided by the invention is simply constructed. It has a minimum number of parts, especially moving parts. It can be made from inexpensive, but durable materials such as plastic by injection, blow, or roto molding or other conventional methods. It allows for easy replacement of the roll. It is aesthetically appealing. It can dispense lower tensile strength sheet material without tearing. It can dispense sheet material with or without a core equally well without modification or installation of additional parts.

The dispenser of the present invention may have other applications aside from use in paper towel rolls and paper toweling. Although the invention has been herein shown and described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims.

We claim:

1. A low cost material dispenser comprising:

a housing comprising a front cover and a rear cover, wherein the front cover and the rear cover cooperate to at least in part define an interior of the housing;

a feed mechanism subassembly separate from the front cover and the rear cover for unwinding material from a roll of material maintained in the interior of said housing, wherein the feed mechanism subassembly comprises at least a feed roller and an idle roller that are rotatably carried by the feed mechanism subassembly, and wherein the feed mechanism subassembly is secured as a unit to the housing; and a ramp located in the interior of said housing for continuously biasing the roll of material against said feed mechanism such that the roll of material is in substantially constant contact with the feed mechanism while the roll is in the interior of said housing.

2. The dispenser of claim 1, wherein the feed mechanism subassembly includes a pair of bearing members to which the feed roller and the idler roller are rotatably mounted without any tools.

3. The dispenser of claim 2, where the front cover attaches to the rear cover without using any tools.

4. The dispenser of claim 1, wherein the ramp comprises a series of supports.

5. The dispenser of claim 4, wherein each said support has at least three different sections of differing degrees of incline.

6. The dispenser of claim 5, wherein each said support has an upper section, a middle section, and a bottom section, the bottom section having a greater degree of incline than the upper section, and the upper section having a greater degree of incline than the middle section.

7. The dispenser of claim 1, further comprising a handle that functionally engages the feed mechanism when the feed mechanism is secured to the housing so that actuation of the handle dispenses sheet material through the feed mechanism.

8. The dispenser of claim 7, where the roll is biased such that the handle can be actuated with less than 5 pounds of pressure.

9. A dispenser comprising:

a housing;

means for supporting a roll of material connected to said housing; and a feed mechanism subassembly through which sheet material from a roll of material positioned in the housing may be dispensed, wherein the feed mechanism subassembly comprises at least one drive roller and one idle roller, wherein the drive roller and idle roller are pre-assembled for rotation in the feed mechanism subassembly and wherein said feed mechanism subassembly is mounted as a unit in the housing without using any tools.

10. The dispenser of claim 9, where the feed mechanism subassembly is snap fit into the housing.

11. The dispenser of claim 9, wherein the feed mechanism subassembly includes a pair of bearing members to which the feed roller and the idler roller are rotatably mounted without using any tools.

12. A low cost roll dispenser comprising:

a housing comprising front and rear covers;

a feed mechanism through which sheet material is dispensed from a roll of material positioned in the housing, wherein the feed mechanism is snap fit into the housing;

a roll biasing device that biases a roll of material so that the roll is constantly in contact with the feed mechanism while the roll is stationary and while the roll is being unwound; and a handle portion that is part of said front cover wherein actuation of the handle portion operates the feed mechanism to unwind a portion of material from the roll.

13. The low cost roll dispenser of claim 12, wherein the dispenser is assembled without using any tools.

14. The low cost dispenser of claim 12, wherein the handle portion snap fits onto the rear cover.

15. The low cost roll dispenser of claim 12, wherein the force necessary to actuate the handle is less than 5 pounds of pressure.

16. The low cost roll dispenser of claim 12, wherein the feed mechanism can be pre-assembled as a stand-alone cassette that can be attached to the housing without using any tools.

17. The low cost roll dispenser of claim 12, where the roll biasing device comprises a series of ramps.

18. A dispenser comprising:

a housing comprising a front cover and a back cover;

a feed mechanism through which sheet material may be dispensed from a roll positioned in the housing, wherein the feed mechanism can be pre-assembled as a stand-alone cassette that can be attached to said housing without using any tools;

a series of supports connected to said housing but not said feed mechanism, wherein said supports bias a roll positioned in said housing so that the roll is in constant contact with both the feed mechanism and the supports while the roll is stationary and while the roll is being unwound;

a handle portion that is a part of said front cover, wherein actuation of the handle portion operates the feed mechanism.

19. The dispenser of claim 18, wherein the supports have at least three different sections of different degrees of incline.

20. The dispenser of claim 19, wherein each said support has an upper section, a middle section, and a bottom section, the bottom section having a greater degree of incline than the upper section, and the upper section having a greater degree of incline than the middle section.

* * * * *